United States Patent [19]

Diedrich

[11] Patent Number: 4,756,052

[45] Date of Patent: Jul. 12, 1988

[54] DOOR STOP

[76] Inventor: James L. Diedrich, P.O. Box 21587, Billings, Mont. 59104

[21] Appl. No.: 772,001

[22] Filed: Sep. 3, 1985

[51] Int. Cl.[4] ..... E05F 5/02

[52] U.S. Cl. ..... 16/82; 292/338

[58] Field of Search ..... 16/82, 85, 346; 292/338

[56] References Cited

U.S. PATENT DOCUMENTS

| | | | |
|---|---|---|---|
| 953,378 | 3/1910 | Daggs | 16/82 |
| 1,812,408 | 6/1931 | Lasier | 16/85 |
| 3,162,889 | 12/1964 | Runnels | 16/82 |
| 3,259,936 | 7/1966 | Sheridan | 16/85 |
| 3,909,877 | 10/1975 | Christy | 16/85 |

FOREIGN PATENT DOCUMENTS

| | | | |
|---|---|---|---|
| 2143173 | 3/1973 | Fed. Rep. of Germany | 292/338 |
| 3202389 | 8/1983 | Fed. Rep. of Germany | 292/338 |
| 319849 | 7/1934 | Italy | 292/338 |

*Primary Examiner*—Kurt Rowan

*Attorney, Agent, or Firm*—Warren F. B. Lindsley

[57] ABSTRACT

A portable, selectively lockable door stop having a pair of telescopingly fitted rods with door brace linkage engaging channels is disclosed. The invention provides an adjustable door stop that coacts with existing door brace linkage to prop the door open at any desired width. The channels are pivotally attached to the ends of the rods in a clevis fashion. A method of keeping a door open is also disclosed.

1 Claim, 1 Drawing Sheet

DOOR STOP

BACKGROUND OF THE INVENTION

1. Field of the Invention

The invention relates to a door stop, and in particular to a portable telescoping strut type door stop that is used in conjunction with the brace linkage found on large doors.

2. Discussion of the Technical Problems

Large industrial doors are found in nearly all modern buildings. They usually are quite heavy having glass or metal panels and are pivotally mounted with strong hinges. Some doors are provided with automatic shock absorber closing mechanisms. The door frames are made of metal or thick wood. Due to the heavy weight and type of construction, the doors are difficult to keep standing open when it is so desired such as while cleaning a carpet or polishing the floor.

Some doors are provided with built-in door stops of various designs including some position stops in the automatic closing mechanisms. Unfortunately, it has been found that the built-in stops often fail or are out of adjustment. Additionally, some upper mounted built-in door stops are too high off the floor for a short person to use.

In order to keep the doors open and combat the problems of built-in door stops, many janitors and other users of door stops carry portable wedges to insert between the bottom edge of the door and the floor. Unfortunately, these conventional portable floor mounted door stops are subject to sliding about when placed on the floor. They are easily misplaced and somewhat limit the usefulness of having a door stop while working on the floor. In order to clean or wax a floor around such a door stop, one necessarily misses the floor area in the vicinity of the door stop. Furthermore, that type of door stop is easily bumped resulting in the door closing anyway.

The ideal door stop would provide the usefulness of the portable wedge type door stop with the floor clearance provided by the built-in type of door stop. It would be easy to use on any door and would be quick to adjust and remove. It should be light weight and strong.

Prior-art portable door stops are generally of the wedge floor type or are of the built-in type previously mentioned.

While no known examples of portable door stops that coact with the door brace linkage or the edge of the door have been discovered, U.S. Pat. No. 3,593,996 issued to Thompson teaches the use of a removable strut for a chinning bar between a door and a sill and U.S. Pat. No. 3,615,114 issued to Harris teaches using a strut to prop open a sliding glass door.

Other built-in door stops having various frame and mechanical arrangements are known, as are brackets for holding open hinged containers for displays Examples of such devices can be found in U.S. Pat. No. 3,418,740 to Gray, U.S. Pat. No. 1,887,365 to Wegner, and U.S. Pat. No. 1,916,882 to Greene.

Very few devices in the known art relate to portable door stops for hinged doors and none known are directed to providing a door stop having an adjustable strut that is light weight and easy to use.

Accordingly, a need exists for a door stop that would provide safe, convenient, easily adapted, light weight means for keeping a door open at any desired angle. Such a door stop would provide a simple, inexpensive apparatus that could be adapted to all hinged doors and in particular to the heavy duty industrial doors with brace linkage between the frame and the door. A door stop of that type would provide a mechanical linkage that is simple in design, easy to maintain, and easy to adjust to accommodate different doors and desired openings.

The device should be uncomplicated in design, easily placed into position and removed. It should be easily repaired, not subject to damage by proper use, and simple to manufacture. The instant invention is directed to all of these needs as well as to others as explained in the following summary.

SUMMARY OF THE INVENTION

It is a feature of the invention to provide a door stop.

It is another feature of the instant invention to provide an adjustable strut door stop.

It is another feature of the instant invention to provide a door stop having a telescoping elongate member with door engaging channels pivotally mounted on either end.

It is another feature of the instant invention to provide a door stop having a telescoping elongate member with door brace linkage engaging channels pivotally mounted on either end.

It is another feature of the instant invention to provide a door stop slideably adjustable with a friction lock.

These and other features and objects are attained according to the instant invention by providing an easily removable door stop for holding doors open from the top of the door. The stop provides a slideably adjustable rod with pivoting plastic semi-circular channels attached at either end. The door stop works by placing the channels around the arms of the shock-absorber brace linkage found on most modern industrial type doors so that the rod acts as a rigid member to prohibit the closure of the door. The stop is used by placing the channels over the arms of the linkage adjacent the linkage connection point and then adjusting the friction lock.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
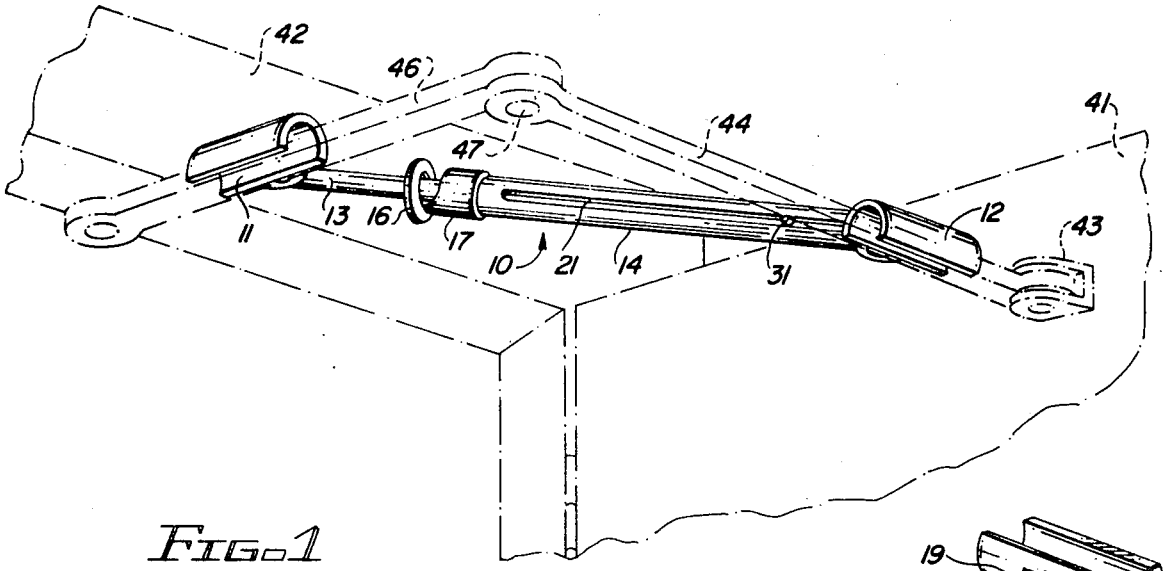
FIG. 1 is a side perspective view of the door stop attached to the brace linkage of a door in accordance with the present invention in which the door and brace linkage environment is depicted in dashed outline.

The door stop 10 of the instant invention is depicted generally in FIG. 1. As can be seen by reference to FIG. 1, the invention provides a strut or prop between the door frame 42 and the door 41. Door brace linkage 44 and 46 can be found on many doors. The brace linkage is often found with an automatic door closure (not shown) or with a shock absorber (not shown). In any case, most industrial doors have at a minimum a brace linkage that provides at least two rods 46 and 44 that pivot at a convenient point 47.

Figure 2:
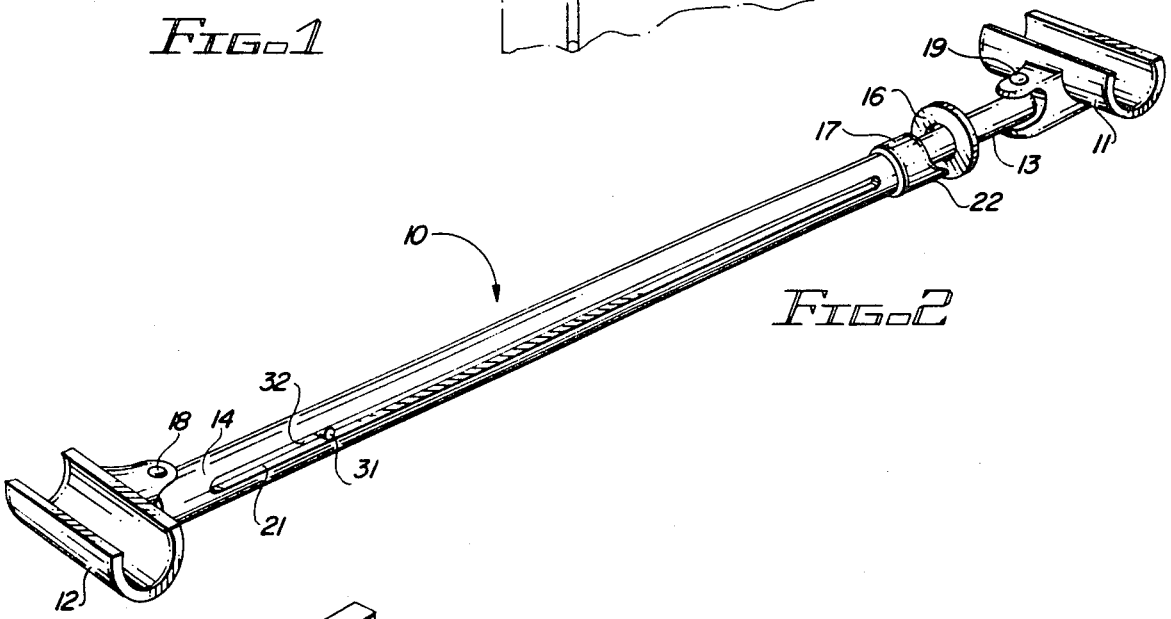
FIG. 2 is an overall perspective view of the door stop in a different orientation from the view of FIG. 1.

As can be seen by careful reference to FIGS. 1 and 2 the door stop 10 of the instant invention provides a telescoping rod of a generally circular configuration in which a smaller diameter rod 13 is inserted into a larger diameter rod 14 in a telescoping fashion. The outside diameter of smaller rod 13 is thus in frictional engagement with the inside diameter of larger rod 14. In order to keep the rods 13 and 14 from rotating with respect to each other, slit 21 has been cut in larger rod 14 on either side of the rod 14 and a pin 31 has been inserted through smaller rod 13 and rigidly affixed to smaller rod 13 so as to extend through slit 21 on either side. It should be noted that pin 31 is located near the end 32 of smaller rod 13 to provide for the maximum extension of the door stop 10. Pin 31 once inserted in rod 13 and extending through slit 21 also provides a limit stop in the maximum travel of the slide provided by rods 13 and 14 and keeps the two rods from coming apart.

Larger rod 14 is provided with a friction lock collar 17 on the end of rod 14 that rod 13 extends therefrom. Collar 17 is provided with a pointed portion 22 and is rigidly affixed to rod 14. Collar 17 is cylindrical in shape with an inside diameter close to the outside diameter of rod 14 so that collar 17 fits over the end of rod 14. Collar 17 is PVC plastic and rods 13 and 14 are aluminum although any suitable material could be used.

Figure 3:
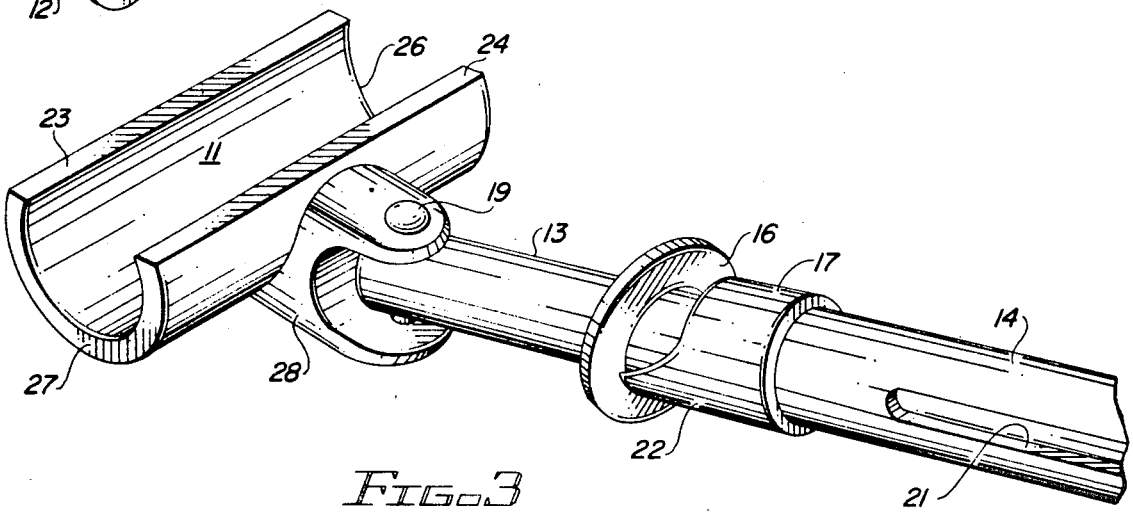
FIG. 3 is a partial perspective view of one end of the door stop depicting the friction lock in accordance with the present invention.

The end of rod 14 opposite collar 17 is provided with a hole that coacts with a pin 18 and flange 28 to provide a pivot attachment. Semi-circular channels 11 and 12 are provided to engage the brace linkage 44 and 46. Channels 11 and 12 are fitted with a flanges 28 as shown in FIG. 3 to provide a clevis pivot in the end of rods 13 and 14. Flanges 28 straddle rod 13 and 14 and pins 18 and 19 are inserted through holes in flanges 28 and rods 13 and 14.

Channels 11 and 12 are rigidly attached to flanges 28 and both channels 11 and 12 and flanges 28 are composed of PVC plastic although other suitable materials may be found without departing from the invention. It should be noted that the arrangement described above provides a pivotal attachment between the channels 11 and 12 and rods 13 and 14 respectively so that the channels are free to pivot approximately 180° degrees before the rods are positioned parallel to the longitudinal axis of the channels and that rods 13 and 14 are free to slide with respect to each other but not to rotate with respect to each other.

Rod 13 is fitted with a circular washer 16 between channel 11 and point 22 of lock collar 17. The diameter of the hole in washer 16 is slightly larger than the outside diameter of rod 13 so that washer 16 is free to slide along rod 13 between flanges 28 and point 22 of collar 17. Washer 16 and collar 17 thus provide a lock that frictionally locks rods 13 and 14 with respect to each other when a force is directed on either end of rods 13 and 14 such as when door stop 10 is placed on braces 44 and 46 and the door 41 is allowed to push against edge 26 or 27 of channel 11 or 12. It has been found that the friction lock works best if washer 16 has an interior hole large enough to allow washer 16 to tilt substantially as shown in FIG. 1. Point 22 of collar 17 pushes against washer 16 thus tilting the washer 16 and binding it in frictional engagement with rod 13 and stopping the sliding of rod 14. The door stop is thus converted to a door holding rigid strut until the pressure on the ends of the door stop 10 is removed allowing rods 13 and 14 to slide with respect to each other.

The use of the invention will now be described with reference to FIGS. 1, 2, and 3. Door 41 is opened to the desired width and rods 13 and 14 are slid apart as far as pin 31 will allow. Channel 12 is placed over brace 44 and channel 11 is placed over brace 46. Rods 13 and 14 are allowed to slide to the desired length corresponding to the desired door open width. Washer 16 is slid until it contacts point 22 of collar 17 and door 41 is released to provide pressure along the longitudinal axis of rods 13 and 14 thus frictionally locking them as previously described. The door is thus propped open without cluttering the floor.

It should be noted that channels 13 and 14 could be placed over any convenient part of sill 42 and door 41 such as the top edge and the door would remain open although not as well as when the channels are placed over the brace linkage.

The door stop 10 can be removed by slightly opening the door 41 to remove the compressive force from rods 13 and 14 thus allowing washer 16 to be slid along rod 13 toward the channel. The door stop is then simply lifted from the brace linkage and carried to the next door.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A method of keeping a door open, the door being of the type having a first brace linkage and a second brace linkage; the method comprising the steps of:

(a) providing a door stop having a first elongate member having a first end and a second end; a second elongate member having a first end and a second end wherein said second end of said first elongate member is slideably disposed to said second end of of said second elongate member; a door brace linkage engaging means pivotally attached to said first end of said first elongate member; a door frame brace linkage engaging means pivotally attached to said first end of said second elongate member; and a locking means for selectively locking said first elongate member with respect to said second elongate member;

(b) positioning the door brace linkage engaging means on said first brace linkage;

(c) positioning the door frame brace linkage engaging means on said second brace linkage; and (d) selectively locking said first elongate member with respect to said second elongate member.

* * * * *

UNITED STATES PATENT OFFICE

CERTIFICATE OF CORRECTION

Patent No. 4,756,052 Dated July 12, 1988

Inventor(s) James L. Diedrich

It is certified that error appears in the above-identified patent and that said Letters Patent are hereby corrected as shown below:

Claim 1, line 8, delete the word "of" at the end of the line.

Signed and Sealed this

Twenty-ninth Day of November, 1988

*Attest:*

DONALD J. QUIGG

*Attesting Officer*

*Commissioner of Patents and Trademarks*